US005748149A

United States Patent [19]

Kawahata

[11] Patent Number: 5,748,149

[45] Date of Patent: May 5, 1998

[54] SURFACE MOUNTING ANTENNA AND ANTENNA APPARATUS

[75] Inventor: Kazunari Kawahata, Kyoto, Japan

[73] Assignee: Murata Manufacturing Co., Ltd., Kyoto-fu, Japan

[21] Appl. No.: 724,793

[22] Filed: Oct. 2, 1996

[30] Foreign Application Priority Data

Oct. 4, 1995 [JP] Japan ..... 7-257874

[51] Int. Cl.[6] ..... H01Q 1/38; H01Q 1/24

[52] U.S. Cl. ..... 343/700 MS; 343/702; 343/846

[58] Field of Search ..... 343/700 MS, 702, 343/829, 846, 848, 722, 749; H01Q 1/38, 1/24

[56] References Cited

U.S. PATENT DOCUMENTS

| | | | |
|---|---|---|---|
| 5,510,802 | 4/1996 | Tsuru et al. | 343/700 MS |
| 5,581,262 | 12/1996 | Kawahata et al. | 343/700 MS |
| 5,585,810 | 12/1996 | Tsuru et al. | 343/700 MS |
| 5,588,198 | 12/1996 | Kawahata et al. | 343/700 MS |

FOREIGN PATENT DOCUMENTS

| | | |
|---|---|---|
| 0332139 | 9/1989 | European Pat. Off. . |
| 0383292 | 8/1990 | European Pat. Off. . |
| 0621653 | 10/1994 | European Pat. Off. . |
| 0637094 | 2/1995 | European Pat. Off. . |

*Primary Examiner*—Hoanganh T. Le

*Attorney, Agent, or Firm*—Ostrolenk, Faber, Gerb & Soffen, LLP

[57] ABSTRACT

A substantially-rectangular-prism-shaped base member is made from at least one of a dielectric material and a magnetic material. A radiation electrode is formed on a surface of the base member such that the electrode is routed from one end face of the base member to the opposing end face through a main surface, changes direction on the end face, and then is routed from the end face to the former end face through the main surface in an almost gate-shaped path. A gap is provided at a part of the radiation electrode, which divides the electrode. With this configuration, a surface mounting antenna is made. This surface mounting antenna is placed on a printed circuit board. One end of the radiation electrode is connected to a power-supplying electrode on the printed circuit board and the other end of the radiation electrode is connected to a ground electrode on the printed circuit board by soldering or adhesion. Then, an antenna apparatus is formed.

27 Claims, 3 Drawing Sheets

FIG. 3
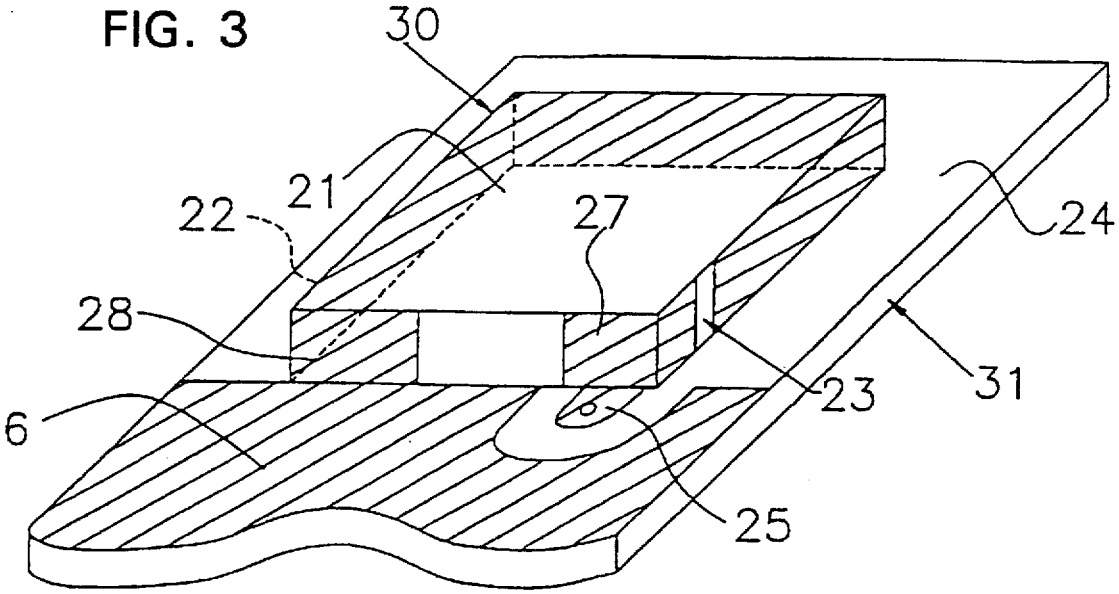
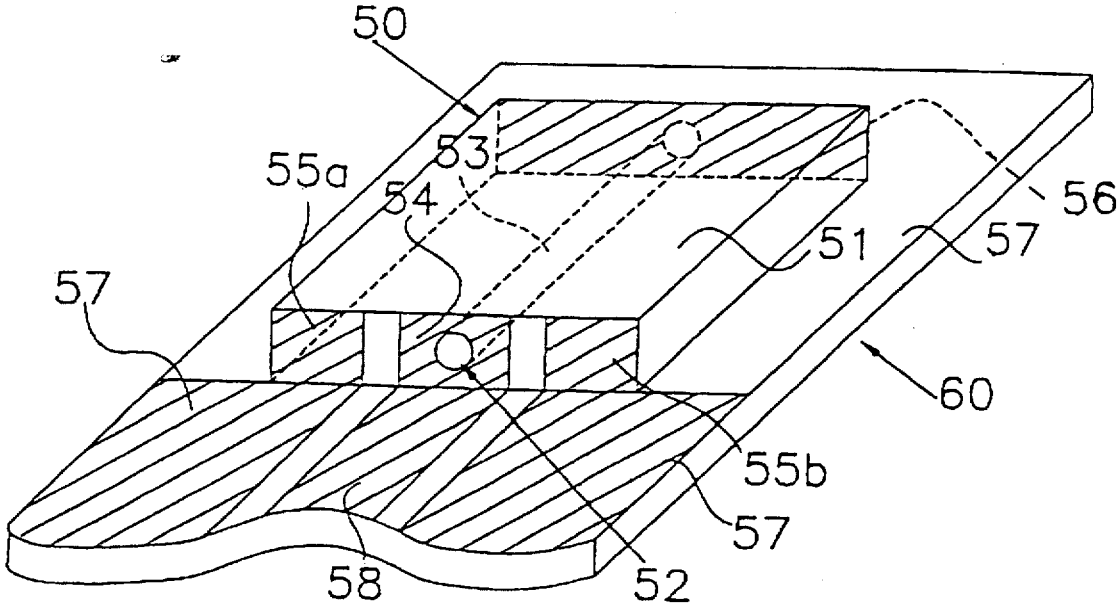
FIG. 4
PRIOR ART

SURFACE MOUNTING ANTENNA AND ANTENNA APPARATUS

BACKGROUND OF THE INVENTION

1. Field of the Invention

The present invention relates to surface mounting antennas and antenna apparatus, and more particularly, to a surface mounting antenna and antenna apparatus used in mobile communication and local area networks (LAN).

2. Description of the Related Art

A conventional surface mounting antenna and an antenna apparatus using the surface mounting antenna will be described below by referring to FIG. 4.

In FIG. 4, there is shown a substantially-rectangular-prism-shaped base member 51 made from at least one of a dielectric material and a magnetic material. Inside the base member 51 an almost cylindrical through hole 52 is formed with its openings being disposed on opposing end faces of the base member 51. A radiation electrode 53 made from, for example, copper is formed on the inner wall of the through hole 52. On one end face of the base member 51 on which an opening of the through hole 52 is disposed, a power-supplying electrode 54 which electrically connects to the radiation electrode 53 is formed. End-face electrodes 55*a* and 55*b* are formed at both sides of the power-supplying electrode 53 such that they are insulated from the power-supplying electrode 54. On the other end face of the base member 51 on which an opening of the through hole 52 is disposed, a capacitive-load electrode 56 which electrically connects to the radiation electrode 53 is formed to complete a surface mounting antenna 50.

This surface mounting antenna 50 is mounted on a printed circuit board 57. The power-supplying electrode 54 is connected to a power-supplying line 58 on the printed circuit board 57 and the end-face electrodes 55*a* and 55*b* are connected to a ground electrode 59 on the printed circuit board 57 by soldering or adhesion. Then, an antenna apparatus 60 is formed. With this configuration, power can be supplied to the radiation electrode 53 and a high-frequency signal can be transmitted and received by the surface mounting antenna 50.

The surface mounting antenna 50 needs to be compact in order to allow its surface mounting onto a printed circuit board. As means for making it compact, the capacitance between the capacitive-load electrode 56 and the end-face electrodes 55*a* and 55*b* increases by using a material having a larger dielectric constant for the base member 51. When the dielectric constant increases, however, a frequency band is narrowed due to a high Q value. In addition, since manufacturing processes such as a process for forming the through hole 52 and a process for making the radiation electrode 53 on the inner wall of the through hole 52 are complicated, they entail high costs.

SUMMARY OF THE INVENTION

Accordingly, it is an object of the present invention to provide a compact, low-cost, easy-to-manufacture surface mounting antenna and antenna apparatus.

The above and other objects are achieved according to one aspect of the present invention through the provision of a surface mounting antenna comprising: a base member; a radiation electrode formed such that the radiation electrode is routed from one end face of the base member back to the end face through at least one of a side face, one main surface, or the other end face; and a gap formed by dividing the radiation electrode, wherein one end of the radiation electrode serves as a ground terminal and the other end is used as a power-supplying terminal.

The radiation electrode may be formed such that the radiation electrode is routed from one end face of the base member through one main surface to the other end face, is curved on the other end face, and is routed back to the former end face from the other end face through the main surface.

The radiation electrode may be formed such that the radiation electrode is routed from one end face of the base member through one side face, the other end face, and the other side face back to the former end face in an almost loop-shaped path.

The above and other objects are achieved according to another aspect of the present invention through the provision of an antenna apparatus including the surface mounting antenna and a printed circuit board having a ground electrode and a power-supplying electrode, wherein the surface mounting antenna is placed on the printed circuit board, the ground terminal is connected to the ground electrode, and the power-supplying terminal is connected to the power-supplying electrode.

As described above, in a surface mounting antenna according to the present invention, since the capacitance of the antenna is made large by forming the gap which generates a capacitor in a part of the radiation electrode, the surface mounting antenna is compact and has a wide frequency band, without using a base member having a high dielectric constant.

The radiation electrode is formed only on a surface of the base member. The manufacturing processes are thus simplified and cost is reduced.

By forming the radiation electrode such that it surrounds the base member at the side faces, the radiation electrode is made long and the frequency band is further extended.

Other features and advantages of the present invention will become apparent from the following description of the invention which refers to the accompanying drawings.

BRIEF DESCRIPTION OF THE DRAWINGS

FIG. 3 is a perspective view of an antenna apparatus in which a surface mounting antenna according to another embodiment of the present invention is mounted on a printed circuit board.

FIG. 4 is a perspective view of an antenna apparatus in which a conventional surface mounting antenna is mounted on a printed circuit board.

DETAILED DESCRIPTION OF EMBODIMENTS OF THE INVENTION

Embodiments of the present invention will be described below by referring to FIGS. 1 to 3.

Figure 1:
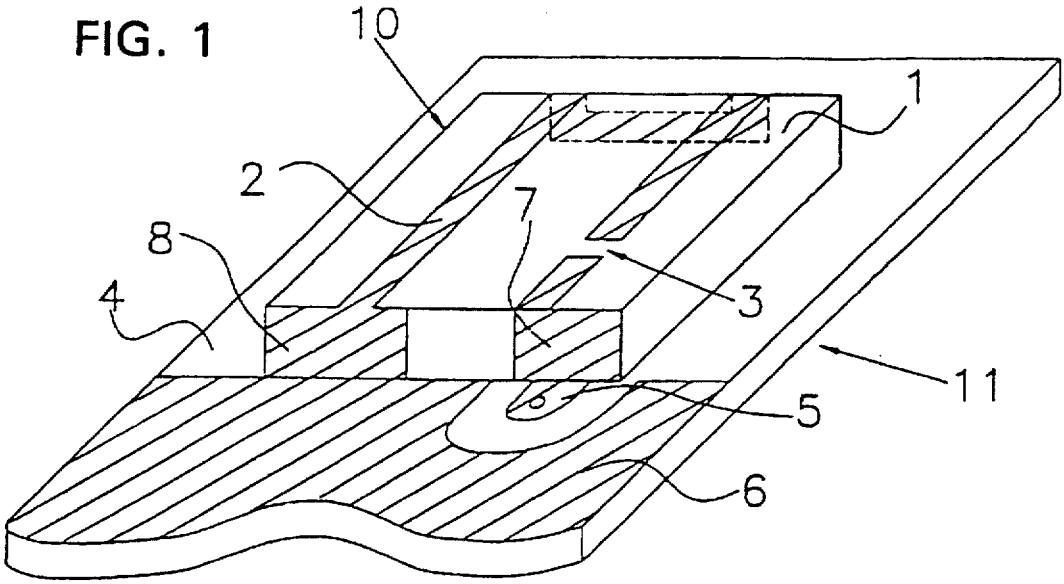
FIG. 1 is a perspective view of an antenna apparatus in which a surface mounting antenna according to one embodiment of the present invention is mounted on a printed circuit board.

In FIG. 1, there is shown a substantially-rectangular-prism-shaped base member 1 made from at least one of a dielectric material and a magnetic material. A radiation electrode 2 is formed by printing on a surface of the base member 1 such that the electrode is routed from one end face of the base member 1 to the opposing end face through a main surface, changes direction on the end face, and then is routed from the end face to the former end face through the main surface in an almost gate-shaped path. A gap 3 is provided at a part of the radiation electrode 2, which divides the electrode 2. Then the surface mounting antenna 10 is completed. One end of the radiation electrode 2 serves as a power-supplying terminal 7 and the other is used as a ground terminal 8.

This surface mounting antenna 10 is mounted on a printed circuit board 4. The power-supplying terminal 7 is connected to a power-supplying electrode 5 on the printed circuit board 4 and the ground terminal 8 is connected to a ground electrode 6 on the printed circuit board 4 by soldering or adhesion. Then, an antenna apparatus 11 is formed. With this configuration, in the surface mounting antenna 10, power can be supplied to the radiation electrode 2 and a high-frequency signal can be transmitted and received.

According to the present invention, manufacturing processes are simplified since the radiation electrode 2 is formed only in the printing process. In addition, since the radiation electrode 2 can be formed to be long, the base member can be made compact. Since the gap 3 is formed in the printing process for the radiation electrode 2 by providing a non-printing portion in the radiation electrode 2, no additional process is required.

Figure 2:
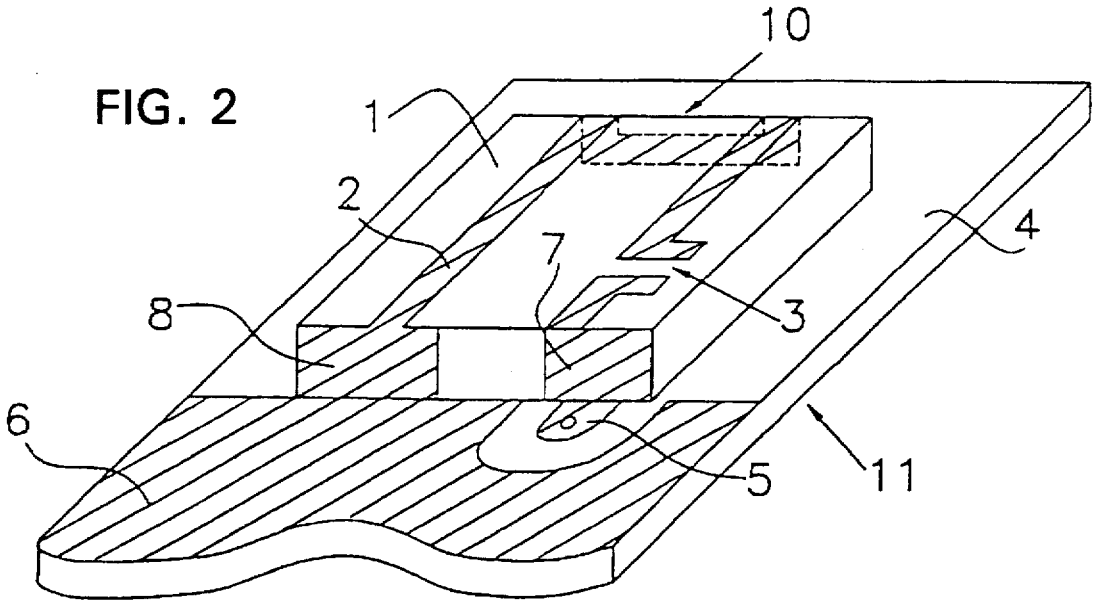
FIG. 2 is a perspective view showing another gap structure in the surface mounting antenna according to an embodiment of the present invention.

As shown in FIG. 2, the radiation electrode 2 may be formed such that longitudinal axes oppose each other in a substantially L-shaped manner around the gap 3. The opposing surfaces become larger than those shown in FIG. 1 and the capacitance of the antenna is made larger. Therefore, the surface mounting antenna can be made more compact.

Another embodiment of the present invention will be described below by referring to FIG. 3. In FIG. 3, there is shown a substantially-rectangular-prism-shaped base member 21 made from at least one of a dielectric material and a magnetic material. A radiation electrode 22 is formed such that the electrode is routed from one end face of the base member 21 through a side face to the opposing end face, and then is routed from the end face through the other side face to the former end face in an almost loop path. A gap 23 is provided at a part of the radiation electrode 22, which divides the electrode 22. Then the surface mounting antenna 30 is completed. One end of the radiation electrode 22 serves as a power-supplying terminal 27 and the other is used as a ground terminal 28.

This surface mounting antenna 30 is mounted on a printed circuit board 24. The power-supplying terminal 27 is connected to a power-supplying electrode 25 on the printed circuit board 4 and the ground terminal 28 is connected to a ground electrode 26 on the printed circuit board 24 by soldering or adhesion. Then, an antenna apparatus 31 is formed. With this configuration of the surface mounting antenna 30, power can be supplied to the radiation electrode 22 and a high-frequency signal can be transmitted and received.

According to the present invention, since the radiation electrode 22 can be formed longer than that in the surface mounting antenna 10, the surface mounting antenna 30 can be made more compact.

The frequency becomes lower as the gap in the radiation electrode is positioned closer to the power-supplying electrode. Although the antenna can be made more compact, the frequency band is narrowed. On the contrary, the frequency becomes higher as the gap is positioned closer to the ground terminal. The antenna needs to be larger, but the frequency band is extended. The position of the gap is accordingly changed depending on the use of the antenna and the frequency and bandwidth required.

Figure 5:
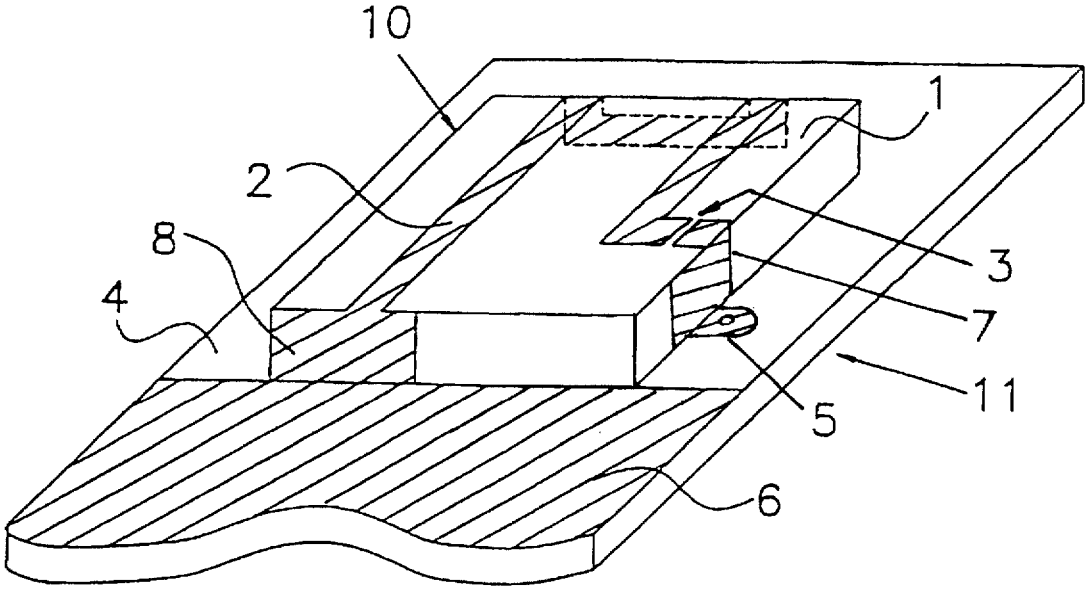
FIG. 5 is a perspective view of a further embodiment of an antenna apparatus in accordance with the present invention.

FIG. 5 shows another embodiment of the surface mounting antenna according to the present invention. Like reference numerals are used for like components as in the embodiment of FIG. 1. The embodiment of FIG. 5 comprises a surface mounted antenna 10 mounted on a printed circuit board 4. Unlike the embodiment shown in FIG. 1, the power-supplying terminal 7 is disposed on a side face of the base member 1. Thus, the power-supplying terminal need not be mounted on the same side face or end face as the ground terminal 8. As shown in the embodiment of FIG. 5, the radiation electrode extends along the main surface from one end face to the opposite end face, changes direction on the opposite end face and then extends back along the main surface toward the first end face. However, as shown in FIG. 5, the radiation electrode terminates before reaching the first end face and a gap 3 is formed between an extension of the power supplying electrode 7 on the main surface and the termination of the radiation electrode 2.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A surface mounting antenna comprising:

a base member having two main surfaces, two end faces and two side faces;

a radiation electrode, the radiation electrode being routed from one end face of said base member back to the end face through at least one of a side face, one main surface, and the other end face; and a gap for applying a capacitance in the radiation electrode formed in said radiation electrode such that said radiation electrode is divided by said gap;

wherein one end of said radiation electrode is connected to a ground terminal and the other end is connected to a power-supplying terminal.

2. A surface mounting antenna according to claim 1, wherein said radiation electrode is formed such that said radiation electrode is routed from one end face of said base member through one main surface to the other end face, changes direction on the other end face, and is routed back to the former end face from the other end face through said main surface.

3. A surface mounting antenna according to claim 1, wherein said radiation electrode is formed such that said radiation electrode is routed from one end face of said base member through one side face, the other end face, and the other side face back to the former end face.

4. A surface mounting antenna according to claim 1, wherein the base member comprises at least one of a dielectric material and a magnetic material.

5. A surface mounting antenna according to claim 1, wherein the radiation electrode is formed by printing on a surface of the base member.

6. A surface mounting antenna according to claim 1, wherein the width of the radiation electrode at the gap can be changed to vary a capacitance of said gap.

7. A surface mounting antenna according to claim 1, wherein the frequency of operation decreases as the gap is positioned closer to the power supplying terminal and increases as the gap is positioned closer to the ground terminal.

8. A surface mounting antenna according to claim 1, wherein the bandwidth is narrowed as the gap is positioned closer to the power supplying terminal and increases as the gap is positioned closer to the ground terminal.

9. An antenna apparatus comprising:

a base member having two main surfaces, two end faces and two side faces;

a radiation electrode, the radiation electrode being routed from one end face of said base member back to the end face through at least one of a side face, one main surface, and the other end face;

a gap for applying a capacitance in the radiation electrode formed in said radiation electrode such that said radiation electrode is divided by said gap;

wherein one end of said radiation electrode is connected to a ground terminal and the other end is connected to a power-supplying terminal;

a printed circuit board having a ground electrode and a power-supplying electrode, wherein said surface mounting antenna is disposed on said printed circuit board, said ground terminal is connected to said ground electrode, and said power-supplying terminal is connected to said power-supplying electrode.

10. An antenna apparatus comprising:

a base member having two main surfaces, two end faces and two side faces;

a radiation electrode, the radiation electrode being routed from one end face of said base member through one main surface to the other end face, changes direction on the other end face, and is routed back to the former end face from the other end face through said main surface;

a gap for applying a capacitance in the radiation electrode formed in said radiation electrode such that said radiation electrode is divided by said gap;

wherein one end of said radiation electrode is connected to a ground terminal and the other end is connected to a power-supplying terminal; and a printed circuit board having a ground electrode and a power-supplying electrode, wherein said surface mounting antenna is disposed on said printed circuit board, said ground terminal is connected to said ground electrode, and said power-supplying terminal is connected to said power-supplying electrode.

11. An antenna apparatus comprising:

a base member having two main surfaces, two end faces and two side faces;

a radiation electrode, the radiation electrode being routed from one end face of said base member through one side face, the other end face and the other side face back to the former end face;

a gap for applying a capacitance in the radiation electrode formed in said radiation electrode such that said radiation electrode is divided by said gap;

wherein one end of said radiation electrode is connected to a ground terminal and the other end is connected to a power-supplying terminal; and a printed circuit board having a ground electrode and a power-supplying electrode, wherein said surface mounting antenna is disposed on said printed circuit board, said ground terminal is connected to said ground electrode, and said power-supplying terminal is connected to said power-supplying electrode.

12. A surface mounting antenna according to claim 1, wherein the base member comprises a rectangular parallelopiped.

13. A surface mounting antenna comprising:

a base member having two main surfaces, two end surfaces and two side surfaces;

a radiation electrode, the radiation electrode being extended from one end surface of said base member through at least two surfaces of said base member; and a gap for applying a capacitance in the radiation electrode formed in said radiation electrode such that said radiation electrode is divided by said gap;

wherein one end of said radiation electrode is connected to a ground terminal and the other end is connected to a power-supplying terminal.

14. A surface mounting antenna according to claim 13, wherein the radiation electrode extends from one end surface of the base member through a main surface and an opposite end surface.

15. A surface mounting antenna of claim 13, wherein the radiation electrode extends from one end surface through a main surface, the opposite end surface and back along the main surface.

16. A surface mounting antenna of claim 15, wherein the power-supplying terminal is an the end surface.

17. A surface mounting antenna of claim 15, wherein the power-supplying terminal is on a side face.

18. A surface mounting antenna of claim 15, wherein the radiation electrode changes direction on the opposite end surface.

19. A surface mounting antenna according to claim 13, wherein said radiation electrode is formed such that said radiation electrode is routed from one end surface of said base member through one main surface to the other end surface, changes direction on the other end surface, and is routed back to the former end surface from the other end surface through said main surface.

20. A surface mounting antenna according to claim 13, wherein said radiation electrode is formed such that said radiation electrode is routed from one end surface of said base member through one side surface, the other end surface, and the other side surface back to the former end surface.

21. A surface mounting antenna according to claim 13, wherein the base member comprises at least one of a dielectric material and a magnetic material.

22. A surface mounting antenna according to claim 13, wherein the radiation electrode is formed by printing on a surface of the base member.

23. A surface mounting antenna according to claim 13, wherein the width of the radiation electrode at the gap can be changed to vary a capacitance of said gap.

24. A surface mounting antenna according to claim 13, wherein the frequency of operation decreases as the gap is positioned closer to the power supplying terminal and increases as the gap is positioned closer to the ground terminal.

25. A surface mounting antenna according to claim 13, wherein the bandwidth is narrowed as the gap is positioned closer to the power-supplying terminal and increases as the gap is positioned closer to the ground terminal.

26. A surface mounting antenna according to claim 13, wherein the ground terminal is on an end surface.

27. An antenna apparatus comprising:

a base member having two main surfaces, two end surfaces and two side surfaces;

a radiation electrode, the radiation electrode being extended from one end surface of said base member through at least two surfaces of said base member;

a gap for applying a capacitance in the radiation electrode formed in said radiation electrode such that said radiation electrode is divided by said gap;

wherein one end of said radiation electrode is connected to a ground terminal and the other end is connected to a power-supplying terminal; and a printed circuit board having a ground electrode and a power-supplying electrode, wherein said surface mounting antenna is disposed on said printed circuit board, said ground terminal is connected to said ground electrode, and said power-supplying terminal is connected to said power-supplying electrode.

* * * * *